United States Patent [19]

Balliello et al.

[11] Patent Number: 4,762,636

[45] Date of Patent: Aug. 9, 1988

[54] PROCESS FOR THE PREPARATION OF GRANULES CONTAINING AN ACTIVE SUBSTANCE AND TO THE USE THEREOF AS SPECKLES FOR TREATING SUBSTRATES

[75] Inventors: Paolo Balliello, Rheinfelden, Fed. Rep. of Germany; Beat Bruttel, Böckten; Hanspeter Will, Frenkendorf, both of Switzerland

[73] Assignee: Ciba-Geigy Corporation, Ardsley, N.Y.

[21] Appl. No.: 17,381

[22] Filed: Feb. 20, 1987

[30] Foreign Application Priority Data

Feb. 28, 1986 [CH] Switzerland ..... 810/86

[51] Int. Cl.[4] ..... C11D 1/22; C11D 3/395; C11D 17/02; C11D 17/06

[52] U.S. Cl. ..... 252/95; 106/503; 252/91; 252/102; 252/135; 252/174.13; 252/186.25; 252/186.35; 252/186.38; 252/301.21; 252/353; 252/357; 252/543; 252/558; 264/117

[58] Field of Search ..... 252/186.35, 186.38, 252/186.25, 539, 353, 357, 558, 135, 95, 102, 91, 174.13, 543, 301.21; 106/309, 308 N; 264/117

[56] References Cited

U.S. PATENT DOCUMENTS

| | | | |
|---|---|---|---|
| 3,451,935 | 6/1969 | Roald | 252/135 |
| 4,228,025 | 10/1980 | Jacobsen | 252/99 |
| 4,256,597 | 0/1981 | Sakkab | 252/99 |
| 4,256,598 | 0/1981 | Sakkab | 252/99 |
| 4,417,994 | 11/1983 | Stoddart | 252/135 |
| 4,443,358 | 4/1984 | Fry | 252/353 |
| 4,652,391 | 3/1987 | Balk | 252/99 |
| 4,680,131 | 7/1987 | Busch | 252/102 |

FOREIGN PATENT DOCUMENTS

| | | | |
|---|---|---|---|
| 119746 | of 1984 | European Pat. Off. | 241/67 |

OTHER PUBLICATIONS

Search Report (excerpt) Swiss Patent Office.

*Primary Examiner*—Paul Lieberman
*Assistant Examiner*—Kathleen Markowski
*Attorney, Agent, or Firm*—Edward McC. Roberts; Meredith C. Findlay

[57] ABSTRACT

A process for the preparation of floating granules ("speckles") by spray drying a solution that contains one or more active substances, a carrier material and a foaming agent, and subsequently compacting the dried material so obtained.

20 Claims, No Drawings

PROCESS FOR THE PREPARATION OF GRANULES CONTAINING AN ACTIVE SUBSTANCE AND TO THE USE THEREOF AS SPECKLES FOR TREATING SUBSTRATES

The present invention relates to a process for the preparation of granules containing an active substance and to the use thereof as speckles for treating substrates.

Conventional speckles, e.g. those used for bleaching substrates during washing in aqueous medium, have the propensity to deposit on to the substrates in the course of such a treatment. This phenomenon usually results in a widely varying concentration of bleaching agent on parts of the substrate and thus corresponds to an unlevel treatment of the substrate.

It has now been found that, by means of a specific formulation and process steps, it is possible to obtain granules with defined physical properties, which granules float on the aqueous treatment liquor and, in the course thereof, release the active substance contained therein uniformly to said treatment liquor from the surface of the liquid phase. Irrespective of the movement of the liquor, a level treatment of the substrate is thus ensured, as reactions limited to small areas or uptake of active substance by or on to the substrate or substrates can no longer occur.

Accordingly, the present invention relates to a process for the preparation of wettable granules that float on water and which contain an active substance, which process comprises spray drying an aqueous solution that contains the active substance, a carrier material and a foaming agent. The microporous solid so obtained is then granulated, e.g. by pulverising a suitable aqueous solution that contains the active substance and the carrier material.

In addition to the granules obtained by the instant process, the present invention relates to the use of said granules as speckles for treating substrates.

Examples of active substances suitable for use in the process of this invention are: photoactivators, especially phthalocyanines, which are disclosed e.g. in U.S. Pat. Nos. 3,927,967 and 4,094,806, European patent applications Nos. A-3 149, A-3 371, A-54 992, U.S. Pat. No. 4,166,718, European patent applications Nos. A-47 716 and A-81 462.

These compounds are used as bleaching agents and especially preferred photoactivators which may be present in the speckles of this invention have the formula

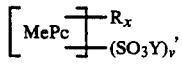

wherein MePc is the zinc phthalocyanine or aluminium phthalocyanine ring system, Y is hydrogen, an alkali metal or ammonium, v is any number from 1 to 4, R is fluorine, chlorine, bromine or iodine, with chlorine being preferred, and x is any number from 0 to 8.

In particularly interesting photoactivators of the above formula, Y is hydrogen or sodium, v is any number from 2.5 to 4, and x is 0 or any number from 0.5 to 1.5.

Further bleaching agents which may suitably be used in the process of this invention are: chlorine donors such as diisocyanates or triisocyanates, chlorites, as well as bleach activators such as N,N,N'N'-tetraacetylethylenediamine, N-acetylimidazole, N-benzoylimidazole, N,N,N',N'-tetraacetylglycoluride, pentaacetyl glycol, alkoxybenzenesulfonates and, in particular, nonyloxybenzenesulfonate and chloroalkoxybenzenesulfonates.

Further suitable active substances are enzymes, dyes such as direct dyes, e.g. Acid Blue 91, 80, 125 S, 127 S, 185, 225 and also Acid Violet 109 pigments (such as Ultramarine Blue), and fluorescent whitening agents. It is also possible to use mixtures of these substances.

A very wide range of substrates can be treated with the speckles of this invention. Examples of suitable substrates are cellulosic fibre materials such as cotton and regenerated cellulose, and also wool, silk, and fibre blends.

Conventional dispersants, such as condensates of naphthalenesulfonic acids with formaldehyde or cresols, may be used as carrier materials. Also suitable are conventional alkylsulfonic acids, alkylanilsulfonic acids and anilsulfonic acids and strongly foaming surfactants, for example those described hereinafter.

Known surfactants may be used as foaming agents. Typical examples are: water-soluble alkylbenzenesulfonates, alkylsulfates, ethoxylated alkyl ether sulfates, paraffin sulfonates, α-olefin sulfonates, α-sulfocarboxylic acids and the salts and esters thereof, alkyl glyceryl ether sulfonates, fatty acid monoglyceride sulfates or sulfonates, alkylphenolpolyethoxy ether sulfates, 2-acyloxyalkanesulfonates, β-alkoxyalkanesulfonates, soaps, ethoxylated fatty alcohols, alkylphenols, polypropoxy glycols, polypropoxyethylenediamines, amine oxides, phosphine oxides, sulfoxides, aliphatic secondary and tertiary amines, aliphatic quaternary ammonium, phosphonium and sulfonium compounds, amphoteric surfactants and derivatives (e.g. betaines) or mixtures of these compounds.

A preferred embodiment of the process of this invention comprises spray drying a solution containing 0.005 to 10% by weight, preferably 0.02 to 1% by weight, of active substance, 1 to 99% by weight, preferably 1 to 10% by weight, of foaming agent, and 1 to 99% by weight, preferably 10 to 99% by weight, of carrier material.

The spray drying may be carried out in suitable driers, with the proviso that the air inlet temperature must be chosen within wide limits in accordance with the thermal stress of the mixture employed. The air inlet temperature will preferably vary within the range from 100° to 450° C., most preferably from 120° to 250° C., whereas the air outlet temperature will normally be in the range from 80° to 115° C., most preferably from 100° to 110° C.

The spray dried material is subsequently compacted to granules with an aqueous solution that contains the active substance and the carier material.

If the light-sensitivity of the active substance requires it, the solution should additionally contain a light stabiliser to ensure the light stability of the speckles.

This aqueous system employed for the subsequent granulation will preferably contain 0.01 to 20% by weight of active substance and 1 to 60% by weight of carrier material.

Suitable devices for obtaining the required granules, i.e. for compacting, are e.g. spray driers, fluidised bed driers, as well as roller driers, cylinder driers, mixer and fluidised bed granulators and also disc pellitisers, which are preferably operated in the process of this invention at room temperature, i.e. normally in the temperature range from 15° to 25° C.

A special embodiment of the process comprises spraying the spray dried material on a disc pelletiser at room temperature with an aqueous solution that contains 0.1 to 20% by weight of photoactivator and 10 to 60% by weight of carrier material.

The granules obtainable by the process of this invention are thus prepared in two steps, with a granulation being carried out after spray drying. However, a single step process is also possible, especially when rapidly dissolving assistants are used as foaming agents, e.g. polyvinylpyrolidone, polyethylene glycol, if appropriate in conjunction with an oxylignosulfonate and/or naphthalenesulfonate, by spraying an aqueous solution which contains an active substance and carrier material and which ensures the optimum wetting and floating properties in a fluidised bed or in a continuous mixer connected downstream of the spray drier.

After the spray drying and after granulation of the dried material, unwanted fractions are preferably separated from the resultant granulate. These fractions comprise granules whose average diameter is outside the range of 0.5 to 1.0 mm, which is the preferred range for useful speckles.

The separation of fine particles or dust and of coarse particles is particularly important for a granulate obtained by a single step procedure. The resultant partial streams can be continuously recycled to the slurry or into the drying aggregate.

The granules so obtained fully meet the requirements made of them and can be used as speckles. They float on the surface of the aqueous liquors, e.g. wash liquors, and permit the release of the active substances contained therein. These are able to disperse uniformly from the surface of the water to the liquor and reach the substrate in homogeneous concentration and act thereon. It is thus possible to achieve a level uptake of active substance by the substrate in optimum manner.

The residual moisture content of the speckles should be in the range from 0 to 20%, preferably from 5 to 20%. This range can be adjusted by appropriate choice of specific drying parameters as well by choosing the weight ratios of fine particles to granulating solution in the second process step.

The bulk density of the speckles is in the range from 50 to 500 g/l, preferably from 200 to 350 g/l.

The invention is illustrated by the following non-limitative Examples.

EXAMPLE 1

Preparation of floating speckles that contain a photoactivator.

The following ingredients are suspended in 100 liters of water and foamed in a 200 liter vessel:

0.100 kg of a sulfonated aluminium phthalocyanine
75.000 kg of a naphthalenesulfonic acid/formaldehyde condensate, and
0.381 kg of sodium dodecylbenzenesulfonate.

The suspension is subsequently spray dried in a jet spray tower (air inlet temperature: 190° C., air outlet temperature: 110° C.).

The spray-dried material is then placed on a disc pelletiser and granulated at room temperature while being sprayed (5 l/h at 5 bar) with an aqueous solution containing 1.834 kg of recycling material or fine particles (see below) and 0.022 kg of Unisperse Blue BE (C.I. 74160) in 1.8 liters of water. The resultant speckles, which substantially have a particle size of 0.5–1 mm, are separated from the fine particles (microparticles) by sieving. These fine particles are recycled for granulation. (it is also possible to charge the spray tower with fine particles).

The speckles hava residual moisture content of 9% and the bulk density is 350 g/l.

EXAMPLE 2

1 liter of water of 35° C. is put into a plastic beaker. A ribbon of cotton weighing 50 g and folded concertina style is immersed in the beaker such that it is covered by the water to a height of 2.5 cm. When the temperature of the water has reached 30° C., 5 g of a basic detergent containing 3% by weight of speckles obtained in Example 1 is sprinkled on to the surface of the water. After 1 minute, the fabric is lightly agitated in the liquor, rinsed, and dried at 60° C. in the dark.

The basic detergent has the following composition:

10.8% by weight of sodium dodecylbenzenesulfonate
2.2% by weight of weight of surfactant
3.0% by weight of sodium soap
30.0% by weight of sodium tripolyphosphate
5.5% by weight of sodium silicate
1.6% by weight of carboxymethyl cellulose
0.2% by weight of EDTA
37.0% by weight of sodium sulfate
0.1% by weight of fluorescent whitening agent
0.02% by weight of fragrance
9.58% by weight of water.

The cotton fabric washed with the detergent containing the speckles of this invention has a fine level white hue, whereas identical treatment with a detergent containing the same concentration of sulfonated aluminium phthalocyanine, but in the form of conventional speckles, i.e. based in this case on sodium chloride, results in a pronounced specky, unlevel blue discolouration.

EXAMPLE 3

The procedure of Example 2 is repeated, using a cotton fabric stained with red wine (Standard Test Fabric, EMPA No. 114) instead of that used in Example 2. After it has been rinsed, the fabric is hung on a line to dry and exposed to sunlight for 3 hours. A levelly bleached cotton fabric is obtained.

What is claimed is:

1. A process for preparing wettable granules that float on and dissolve in water, said granules containing at least one active substance, which process comprises:

(1) spray drying an aqueous solution that contains: (a) at least one active substance selected from the following bleaching agents, dyes, fluorescent brightening agents and finely particulate pigments; (b) at least one carrier selected from the group consisting of condensates of naphthalenesulfonic acids with formaldehyde or cresols, alkylsulfonic acids, alkylanilisulfonic acids and anilsulfonic acids; and (c) at least one foaming agent; and (2) subsequently granulating the product of step (1) by spraying it with an aqueous solution that contains: (a) at least one of the active substances of step (1), and (b) at least one carrier material of step (1);

the amounts of all ingredients being chosen to provide an effective amount of the active substance for subsequent use of the granules and of the carrier and foaming agent to provide floatability and solubility of the granules in water.

2. A process according to claim 1, wherein the active substance is a bleaching agent.

3. A process according to claim 2, wherein the bleaching agent is a bleach activator, a photoactivator, a chlorite or a chlorine donor.

4. A process according to claim 1, wherein the active substance is a dye or a fluorescent whitening agent.

5. A process according to claim 4, wherein the dye is a direct dye.

6. A process according to claim 4, wherein the active substance is a very finely particulate pigment.

7. A process according to claim 3, wherein the chlorine donor is a diisocyanurate or a triisocyanurate.

8. A process according to claim 3, wherein the bleach activator is selected from the group consisting of N,N,N'N'-tetraacetylethylenediamine, N-acetylimidazole, N-benzoylimidazole, N,N,N',N'-tetraacetylglycoluride, pentacetyl glycol, alkoxybenzenesulfonates, in particular, nonyloxybenzenesulfonate and chloroalkoxybenzenesulfonates.

9. A process according to claim 3, wherein the active substance is a photoactivator of formula

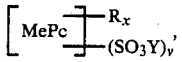

wherein MePc is the zinc phthalocyanine or aluminium phthalocyanine ring system, Y is hydrogen, an alkali metal or ammonium, v is any number from 1 to 4, R is fluorine, chlorine, bromine or iodine, with chlorine being preferred, and x is any number from 0 to 8.

10. A process according to claim 1, wherein the carrier is a condensate of naphthalenesulfonic acid (sodium salt).

11. A process according to claim 1, wherein the foaming agent is selected from the group consisting of water-soluble alkylbenzenesulfonates, alkylsulfates, ethoxylated alkyl ether sulfates, paraffin sulfonates, α-olefin sulfonates, α-sulfocarboxylic acids and the salts and esters thereof, alkyl glyceryl ether sulfonates, fatty acid monoglyceride sulfates or sulfonates, alkylphenolpolyethoxy ether sulfates, 2-acyloxyalkanesulfonates, β-alkoxyalkanesulfonates, soaps, ethoxylated fatty alcohols, alkylphenols, polypropoxy glycols, polypropoxyethylenediamines, amine oxides, phosphine oxides, sulfoxides, aliphatic secondary and tertiary amines, aliphatic quaternary ammonium, phosphonium and sulfonium compounds, amphoteric surfactants, or mixtures of these compounds.

12. A process according to claim 1, wherein the solution to be spray dried contains 0.005 to 10% by weight of active substance, 1 to 99% by weight of foaming agent, and 1 to 99% by weight of carrier material.

13. A process according to claim 12, wherein the solution to be spray dried contains 0.02 to 1% by weight of active substance, 1 to 10% by weight of foaming agent, and 10 to 99% by weight of carrier material.

14. A process according to claim 1, wherein the air inlet temperature for the spray drying is in the range from 100°–450° C. and the air outlet temperature is in the range from 80°–115° C.

15. A process according to claim 1, wherein the aqueous system employed for compacting contains 0.01 to 20% by weight of active substance and 1 to 60% by weight of carrier material.

16. A process according to claim 15, wherein the compacting is carried out on a granulating device by spraying the material to be granulated at room temperature with a solution containing 0.1 to 20% by weight of active substance and 10 to 60% by weight of a carrier material.

17. A process according to claim 16, wherein the granules obtained have a residual moisture content of 5 to 20% by weight and a bulk density of 200 to 350 g/l.

18. Granules obtained by the process as claimed in claim 1.

19. A method of treating substances, which comprises contacting said substances with a composition containing the granules obtained according to claim 1.

20. A detergent composition containing 1 to 10% by weight of the granules of claim 19.

* * * * *